US008919805B2

(12) United States Patent
Giordani

(10) Patent No.: US 8,919,805 B2
(45) Date of Patent: Dec. 30, 2014

(54) SKI BINDING DEVICE FOR FASTENING A MOUNTAINEERING BOOT ON A DOWNHILL SKI OR THE LIKE

(75) Inventor: Roberto Giordani, Rovereto (IT)

(73) Assignee: Tasci, S.R.L. (IT)

( * ) Notice: Subject to any disclaimer, the term of this patent is extended or adjusted under 35 U.S.C. 154(b) by 0 days.

(21) Appl. No.: 14/117,129

(22) PCT Filed: May 14, 2012

(86) PCT No.: PCT/IB2012/052403

§ 371 (c)(1),
(2), (4) Date: Mar. 31, 2014

(87) PCT Pub. No.: WO2012/156899

PCT Pub. Date: Nov. 22, 2012

(65) Prior Publication Data

US 2014/0312598 A1 Oct. 23, 2014

(30) Foreign Application Priority Data

May 13, 2011 (IT) ..... TV2011A0062

(51) Int. Cl.
*A63C 9/084* (2012.01)
*A63C 9/086* (2012.01)
*A63C 9/00* (2012.01)
*A63C 9/08* (2012.01)

(52) U.S. Cl.
CPC ..... *A63C 9/006* (2013.01); *A63C 9/0807* (2013.01)
USPC ..... 280/614; 280/623

(58) Field of Classification Search
CPC ..... A63C 9/003; A63C 9/086; A63C 9/18; A63C 9/0807
USPC ..... 280/611, 613, 614, 617, 623, 632, 633
See application file for complete search history.

(56) References Cited

U.S. PATENT DOCUMENTS 4,261,595 A * 4/1981 Smialowski et al. ..... 280/614
4,512,594 A * 4/1985 Eyre ..... 280/614

(Continued)

FOREIGN PATENT DOCUMENTS

EP 0519243 12/1992
EP 1559455 8/2005

(Continued)

OTHER PUBLICATIONS

International Search Report and Written Opinion, International Application No. PCT/IB2012/052403 (Oct. 10, 2012).
Search Report and Opinion, Italian Application No. TV2011A000062 (Dec. 23, 2011).

*Primary Examiner* — John Walters
(74) *Attorney, Agent, or Firm* — Thompson Hine, L.L.P.

(57) ABSTRACT

A ski binding device for fastening a boot on a ski is described. The device includes a toepiece and a heelpiece fixed to the ski and structured to selectively retain the boot. The heelpiece includes a turret and a hooking projecting appendix ("HPA") that juts out from the turret towards the toepiece while remaining substantially parallel to a first reference axis. The HPA includes a latch element insertable through the turret and configured to move forwards and backwards with respect to the turret parallel to the first reference axis. The turret includes a heel rising member movable from and towards a working position supporting the boot in a raised position and a mechanical connecting member connecting the heel rising member to the latch element to transmit the translating motion of the latch element to the heel rising member to move the heel rising member substantially together with the latch element.

13 Claims, 6 Drawing Sheets

(56) References Cited

U.S. PATENT DOCUMENTS

| | | | | |
|---|---|---|---|---|
| 8,388,013 | B2 * | 3/2013 | Indulti | 280/623 |
| 8,746,728 | B2 * | 6/2014 | Shute et al. | 280/614 |

FOREIGN PATENT DOCUMENTS

| | | |
|---|---|---|
| EP | 1997397 | 12/2008 |
| WO | 2009/105866 | 9/2009 |

* cited by examiner

SKI BINDING DEVICE FOR FASTENING A MOUNTAINEERING BOOT ON A DOWNHILL SKI OR THE LIKE

TECHNICAL FIELD

The present invention relates to a ski binding device for fastening a ski mountaineering boot on a downhill ski or the like.

BACKGROUND ART

As known, the most common ski mountaineering boots substantially consist of a shell made of rigid plastic material which is shaped so as to accommodate the user's foot, and is provided on the bottom with a front sole and a rear heel, usually provided with a lugged profile and made of a non-slip elastomeric material; with a cuff made of a rigid plastic material, which is C-shaped so as to envelop the user's ankle from behind, and is hinged to the upper part of the shell so as to oscillate about a transversal reference axis substantially coinciding with the articulation axis of the ankle; with an inner shoe made of soft, heat-insulating material, which is removably inserted into the shell and the cuff, and is shaped so as to envelop and protect both the foot and the lower part of the user's leg; and with a series of manually-operated closing hooks, which are appropriately distributed on the shell and on the cuff, and are structured so as to tighten the shell and the cuff in order to immobilize the user's leg inside the shoe.

Furthermore, the shell of the ski mountaineering boots is provided on the front with a small, substantially duck-billed projecting appendix, which protrudes from the nose-shaped tip of the shell remaining locally substantially coplanar with the front sole, and is structured so as to be coupled in a rigid, stable, although easily releasable manner, with the toepiece of the ski mountaineering binding device which, in turn, is rigidly fixed onto the central part of the downhill ski.

The ski mountaineering binding device instead consists of a toepiece and a heelpiece, which are rigidly and stably fixed to the back of the downhill ski, at a predetermined distance from each other, and are structured so as to alternatively and as desired:

- lock the shell of the ski boot onto the back of the ski, thus preventing any relative movement between the two elements; or
- lock the shell of the ski boot onto the back of the ski thus allowing the boot to freely oscillate/pivot with respect to the ski about a transversal rotation axis arranged horizontally and roughly positioned at the duck-billed appendix of the shell.

Obviously, the rotation axis of the ski boot is perpendicular to the rotation axis of the downhill ski, i.e. is oriented so as to be locally substantially perpendicular both to the middle plane of the ski and to the middle plane of the ski boot.

In particular, the toepiece is usually provided with a gripper-like clamping member, which is structured so as to clamp and stably retain the projecting duck-billed appendix of the shell, while allowing the shell to freely oscillate/pivot with respect to the ski underneath about the rotation axis of the boot. The heelpiece of the binding device, instead, is structured so as to selectively hook and lock the rear part of the shell, so as to selectively prevent the boot from rotating by pivoting on the toepiece and moving the heel away from the back of the ski.

Furthermore, some models of ski mountaineering binding devices are provided with a heel rising device, which is usually fixed directly onto the heelpiece, and is structured so as to be manually movable by the skier to a working position, in which it prevents the heel of the boot from being lowered back close to the back of the downhill ski.

This operating configuration allows the skier to climb up very steep stretches more comfortably.

Unfortunately, positioning the heel rising device in the operating position is a relatively laborious operation, which may create some problems to the least expert skiers, especially when operating on fresh snow or however in bad weather conditions.

DISCLOSURE OF INVENTION

It is the object of the present invention to provide a ski mountaineering binding device which is simpler and easier to be used than those which are currently known and which also is cost-effective to be manufactured.

In accordance with these objectives, according to the present invention, a binding device is made for fastening a ski mountaineering boot to a downhill ski or the like, as set forth in claim 1 and preferably, but not necessarily, in any one of the dependent claims.

BRIEF DESCRIPTION OF THE DRAWINGS

The present invention will now be described with reference to the accompanying drawings, which show a non-limitative embodiment thereof, in which:

FIG. 9 is a side view of the heelpiece of the ski mountaineering binding device shown in FIG. 1, in a second operating configuration; whereas

BEST MODE FOR CARRYING OUT THE INVENTION

Figure 1:
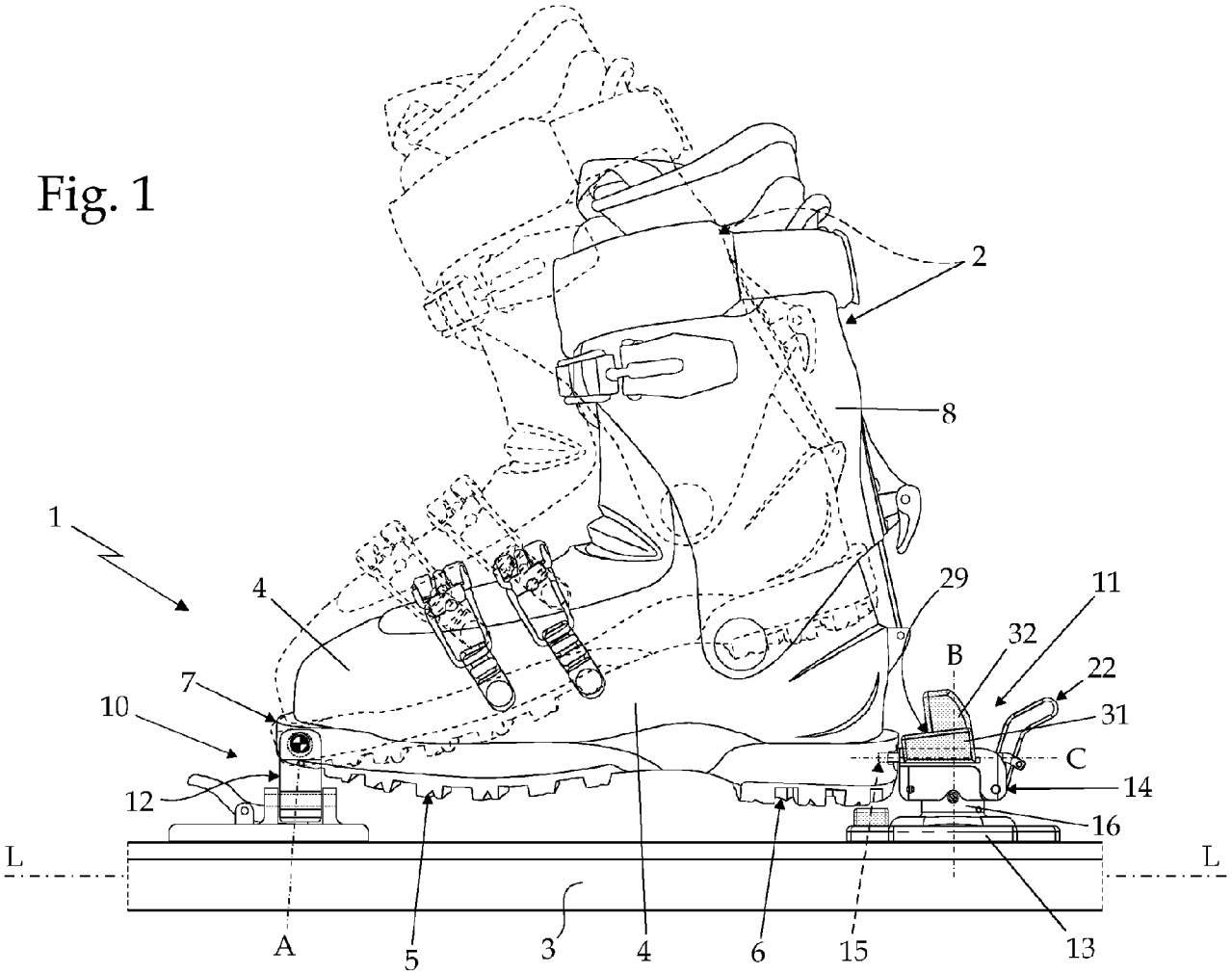
FIG. 1 is a side view of the central segment of a downhill ski which carries a ski mountaineering boot fixed to its back by means of a ski mountaineering binding device made according to the dictates of the present invention.

With reference to FIG. 1, numeral 1 indicates as a whole a ski mountaineering binding device specifically structured to fasten a ski mountaineering or Telemark ski boot 2 onto the central segment of a downhill ski 3, ski mountaineering ski or the like, of the known type, in a stable, although easily releasable manner.

More in detail, the binding device 1 is structured to fasten a ski mountaineering or Telemark ski boot 2 of known type onto the central segment of a downhill ski 3 or the like, which ski boot is provided with a rigid lower shell 4 made of plastic and/or composite material, which is shaped so as to accommodate the user's foot, and is further provided on the bottom with a front sole 5 and a rear heel 6, which preferably, but not necessarily have a lugged profile and are preferably, but not necessarily, made of a non-slip elastomeric material.

Furthermore, the shell 4 is also provided in the front with a small, substantially duck-billed appendix 7, which protrudes from the nose-shaped tip of the shell 4 while remaining locally substantially coplanar to the front sole 5, and is structured so as to be coupled/hooked to the binding device 1 which, in turn, is rigidly fixed to the central segment of the downhill ski 3.

With particular reference to FIG. 1, in the example shown, the ski boot 2, in addition to the shell 4, also comprises a rigid cuff 8 made of a plastic and/or composite material, which is substantially C-shaped so as to envelop the user's ankle from behind, and is hinged onto the upper part of the shell 4 so as to freely oscillate about a transversal reference axis, which is substantially perpendicular to the middle plane of the ski boot (i.e. perpendicular to the sheet plane in FIG. 1), and also substantially and locally coincides with the articulation axis of the user's ankle; an inner shoe made of a soft, heat-insulating material, which is removably inserted into shell 4 and cuff 8, and is shaped so as to envelop and protect both the foot and the lower part of the user's leg; and a series of manually-operated closing hooks, which are positioned on the shell 4 and on the cuff 8, and are structured so as to tighten the shell 4 and the cuff 8 so as to immobilize the user's leg in the shoe 8.

Additionally, shell 4 is finally, preferably but not necessarily, provided with a transversal stiffening bar (not shown) made of a metal material, which extends into the projecting duck-billed appendix 7 while remaining locally substantially perpendicular to the middle plane of the ski boot, and has its two axial ends which emerge/surface from the outside of the projecting appendix 7 at the two side edges of the same appendix.

With reference to FIG. 1, the ski mountaineering binding device 1 instead consists of a toepiece 10 and a heelpiece 11 which are rigidly fixed onto the back of the central segment of the downhill ski 3, aligned along the longitudinal axis L of ski 3, at a predetermined distance from each other, and are structured so as to selectively clamp/hook and retain the front part and the rear part of shell 4, respectively.

More in detail, the toepiece 10 and the heelpiece of the ski mountaineering binding device 1 are structured so as to selectively and as desired:

- stably clamp and retain the front part and the rear part of shell 4 on the central segment of ski 3, thus maintaining the shell 4 immobile on the ski 3 with the sole 5 substantially parallel to the back of the downhill ski 3; or
- stably clamp and retain only the front part of shell 4 on the central segment of ski 3, while allowing the ski boot 2 to freely oscillate/pivot on the back of the ski 3 about a substantially horizontal rotation axis A, which is positioned immediately over the ski 3, at or however close to the tip of shell 4, and is substantially and locally perpendicular to the longitudinal axis L of ski 3 and to the middle plane of the ski boot 2.

In other words, toepiece 10 is provided with a gripper-like clamping member 12 or the like which is structured so as to selectively clamp and retain only the front part of the shell 4, while allowing the front part of the shell 4 to freely oscillate/pivot on the toepiece 10 about the rotation axis A of the ski boot.

Heelpiece 11 is instead structured so as to selectively hook and lock/retain the rear part of the shell 4 roughly at the heel, so as to stably retain the heel 6 of the ski boot 2 in abutment on, or however close to, the back of the ski 3, and therefore prevent any rotation of the ski boot 2 on the toepiece 10 about the rotation axis A of the ski boot.

With reference to FIG. 1, in the example shown, the clamping member 12 of the toepiece 10 is structured so as to tighten the side edges of the projecting appendix 7 of the shell, thus being in abutment on the projecting appendix 7 at the two axial ends of the transversal stiffening bar possibly embedded in the appendix itself, while allowing the projecting appendix 7 of the shell to freely oscillate/pivot with respect to the toepiece 10 at the contact points between the gripper-like clamping member 12 and the side edges of the projecting appendix 7.

In other words, the rotation axis A of the ski boot is positioned on the projecting appendix 7 of shell 4, at the contact points between the gripper-like clamping member 12 and the side edges of the projecting appendix 7. Furthermore, when the front part of shell 4 is fixed onto the toepiece 10 by means of the clamping member 12, the longitudinal axis of the transversal stiffening bar of the projecting appendix 7, if present, coincides with the rotation axis of the ski boot 2.

The toepiece 10 of the ski mountaineering binding device 1 is a component widely known in the field and will not be further described.

Figure 2:
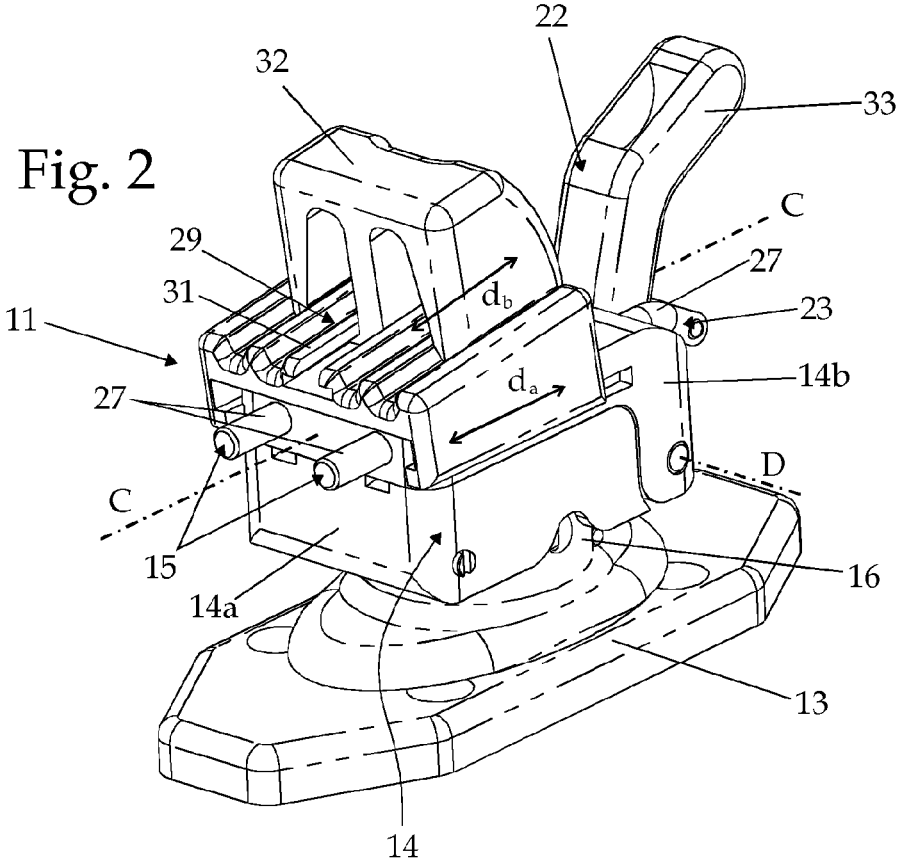
FIGS. 2 and 3 are two axonometric views of the heelpiece of the ski mountaineering binding device shown in FIG. 1.
Figure 3:
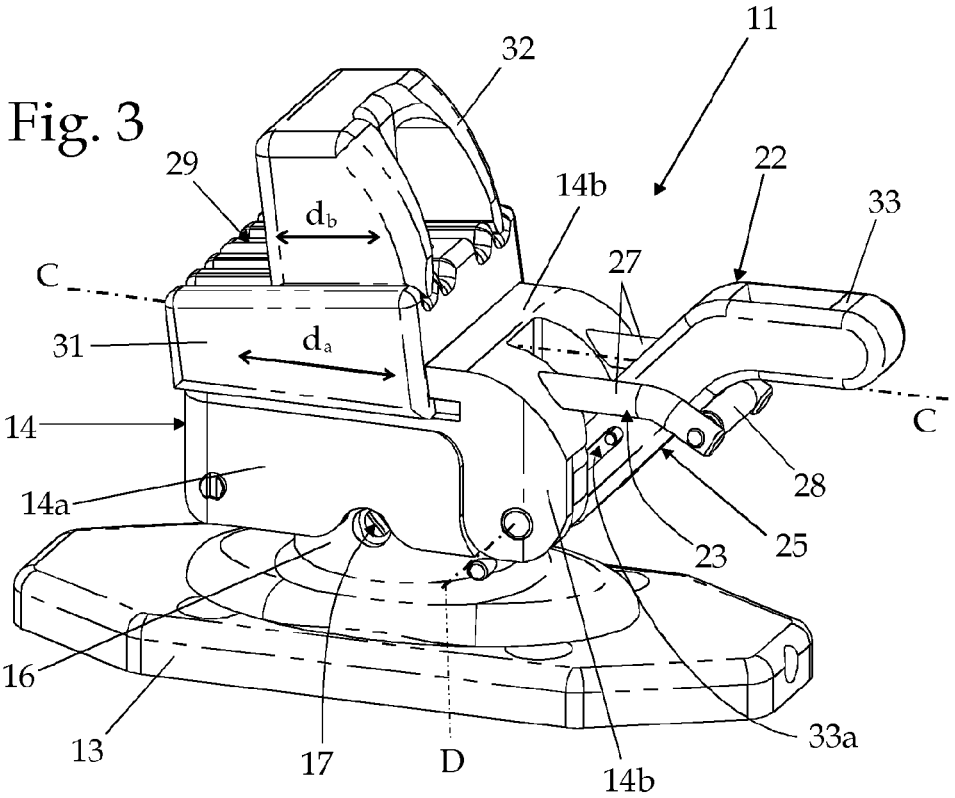

With reference to FIGS. 1, 2 and 3, the heelpiece 11 of the ski mountaineering binding device 1 comprises instead a fastening plate or base 13 which is structured so as to be rigidly fastened to the back of the downhill ski 3 or the like; and a turret 14 which protrudes upwards from the upper face of the fastening plate 13, parallel to a reference axis B which is preferably, but not necessarily, locally substantially perpendicular to the laying plane of the fastening plate 13, i.e. is locally substantially perpendicular to the back of the ski 3 itself and to the longitudinal ski axis L.

Furthermore, heelpiece 11 comprises a hooking projecting appendix 15 which juts out from the turret 14 towards the toepiece 10, and is structured so as to hook/couple to the rear part of the shell 4 roughly at the heel, so as to stably retain the heel 6 of the ski boot 2 in abutment on, or however close to, the back of the ski 3, thus preventing any rotation of the ski boot 2 on the toepiece 10 about the rotation axis A of the boot.

More in detail, the hooking projecting appendix 15 juts out from the turret 14 remaining locally substantially parallel to a reference axis C which is preferably arranged locally substantially parallel to, or however aligned with, the longitudinal axis L of ski 3, and is shaped/structured so as to reach and engage the rear part of the shell 4 to stably retain the heel 6 of the ski boot 2 in abutment on, or however close to, the back of ski 3, when axis C is parallel to, or however substantially aligned with, the longitudinal ski axis L.

Furthermore, the heelpiece 11 is positioned on the central segment of the downhill ski 3 or the like at a predetermined nominal distance from the clamping member 12 of the toepiece 10, so as to allow the projecting appendix 15 to reach and stably hook/lock the rear part of the shell 4, when the clamping member 12 of the toepiece 10 is tightened/closed on the projecting appendix 7 of shell 4 and allows the ski boot 2 to rotate on the toepiece 10 about axis A.

The value of the distance between toepiece 10 and heelpiece 11 obviously depends on the dimensions/length of the shell 4, i.e. on the size of the ski boot 2.

With reference to FIGS. 4, 5, 6 and 7, in particular in the example shown, the turret 14 is preferably fixed onto the fastening plate 13 with the possibility of freely rotating about axis B, and the heelpiece 13 is preferably also provided with an elastic programmed-release locking member 17, which is structured so as to allow the rotation of turret 14 about axis B when the twisting torque exceeds a predetermined threshold value.

In other words, the elastic locking member 17 is structured so as to elastically contrast any rotation of turret 14 about axis B, which would compromise the alignment between reference axis C of the hooking appendix 15 and the longitudinal ski axis L, such an alignment allowing the projecting appendix 15 to engage the rear part of shell 4 so as to stably retain the heel 6 of the ski boot 2 in abutment on, or however close to, the back of ski 3, thus preventing any rotation of the ski boot 2 about axis A.

In the example shown, in particular, the upper turret 14 is partially inserted and locked in an axially rotational manner within a tubular cylindrical hub 16 which juts out from the upper face of the fastening plate 13, thus remaining locally coaxial to the rotation axis B of the turret 14.

Instead, the elastic locking member 17 is preferably, but not necessarily, accommodated in the portion of turret 14 which is rotationally inserted into the hub 16, and comprises:

- a helical spring 18 or similar elastic element, which is inserted into a through hole 19 made in a diametrical position on the portion of the turret 14 which is rotationally inserted into the hub 16;
- a locking ball or pin 20, which is inserted in an axially sliding manner at a first end/mouth of the through hole 19; and finally
- a threaded dowel 21 screwed at the second end/mouth of the through hole 19.

The helical spring 18 is fitted in the through hole 19 so that one of its two ends abuts on the locking ball 20 and the other is on the threaded dowel 21, and is preloaded under compression by means of the threaded dowel 21, so as to push and strongly maintain the locking ball 20 abutting on the inner surface of the hub 16, within a stop seat or recess 20*a* appropriately obtained on the cylindrical tubular wall of hub 16.

With reference to FIGS. 2, 3, 4, 5 and 6, the hooking projecting appendix 15 of the heelpiece 11 is fixed instead onto the turret 14 with the possibility of moving with respect to the turret 14 between a completely extracted position (see FIGS. 1, 2, 4 and 5), in which the hooking projecting appendix 15 juts out from the body of the turret 14 by a predetermined length $l_1$ sufficient to completely engage the rear part of shell 4 so as to prevent any rotation of the ski boot 2 about axis A; and a retracted position (see FIGS. 3 and 7), in which the hooking projecting appendix 15 is completely retracted within the body of the turret 14, or juts out from the body of the turret 14 by a length $l_2$ which is considerably lower than length $l_1$, so as to not reach and lock the rear part of shell 4.

Additionally, the heelpiece 11 also comprises a manually-operated command device 22, which is structured so as to selectively and alternatively move and lock the hooking projecting appendix 15 either in the completely extracted position or in the retracted position.

More in detail, the command device 22 can arrange the hooking projecting appendix 15 alternatively and as desired either in the completely extracted position or in the retracted position, by moving the projecting appendix 15 with respect to the turret 14 in a direction d locally parallel to reference axis C of the protruding appendix itself.

Figure 4:
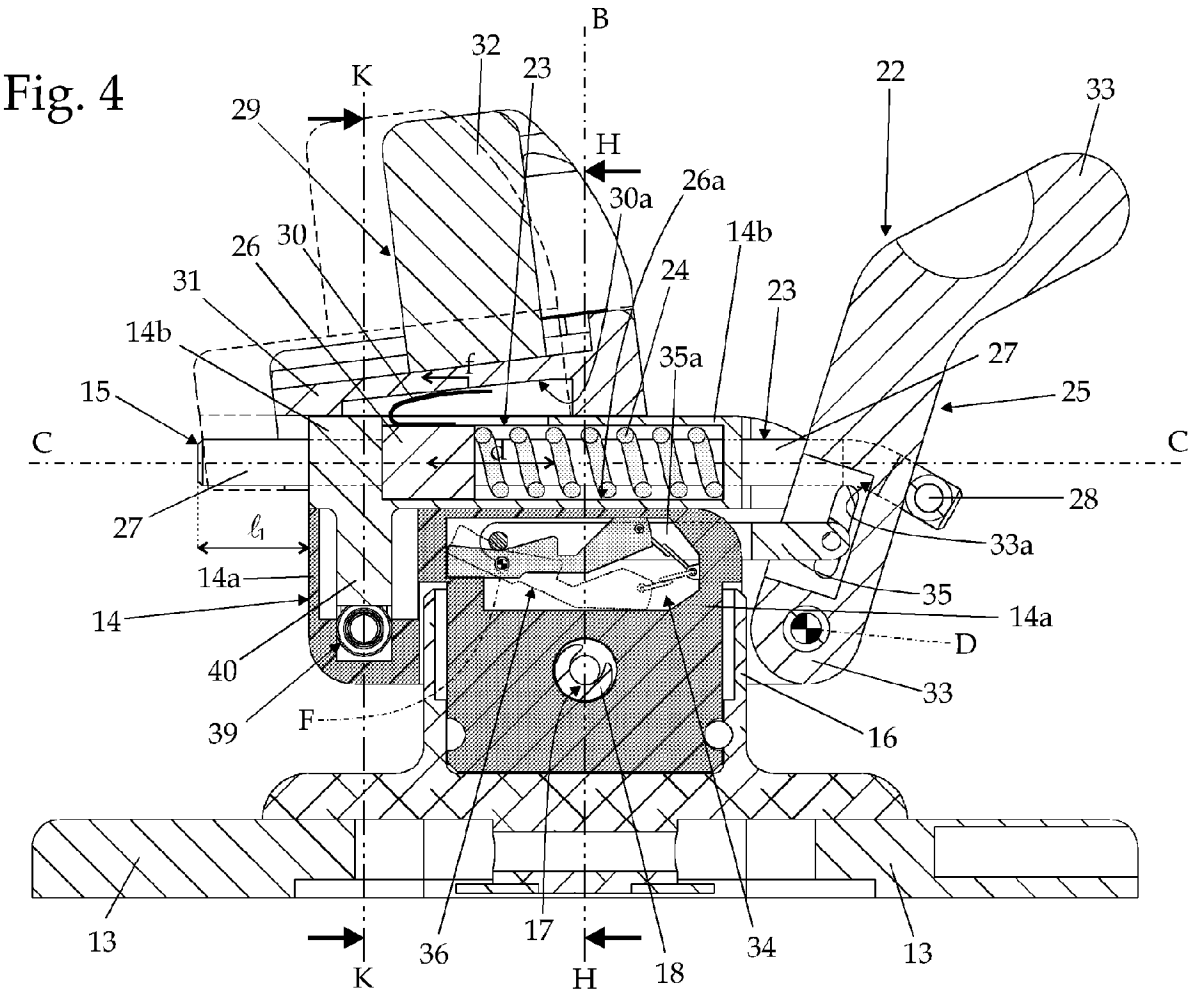
FIGS. 4, 5 and 6 are three side views of the heelpiece of the ski mountaineering binding device shown in FIG. 1, taken along the vertical middle plane.
Figure 5:
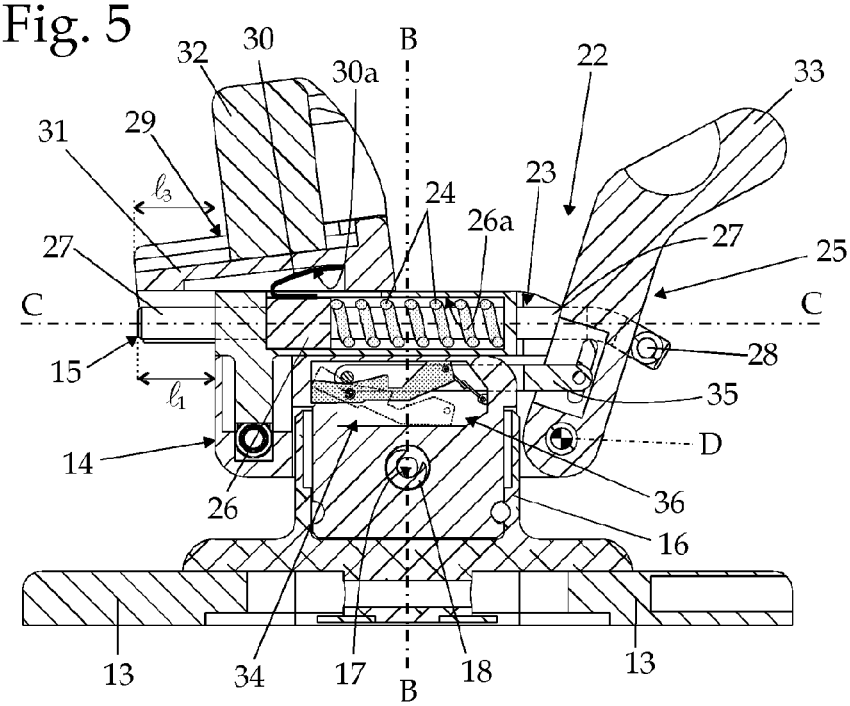
Figure 6:
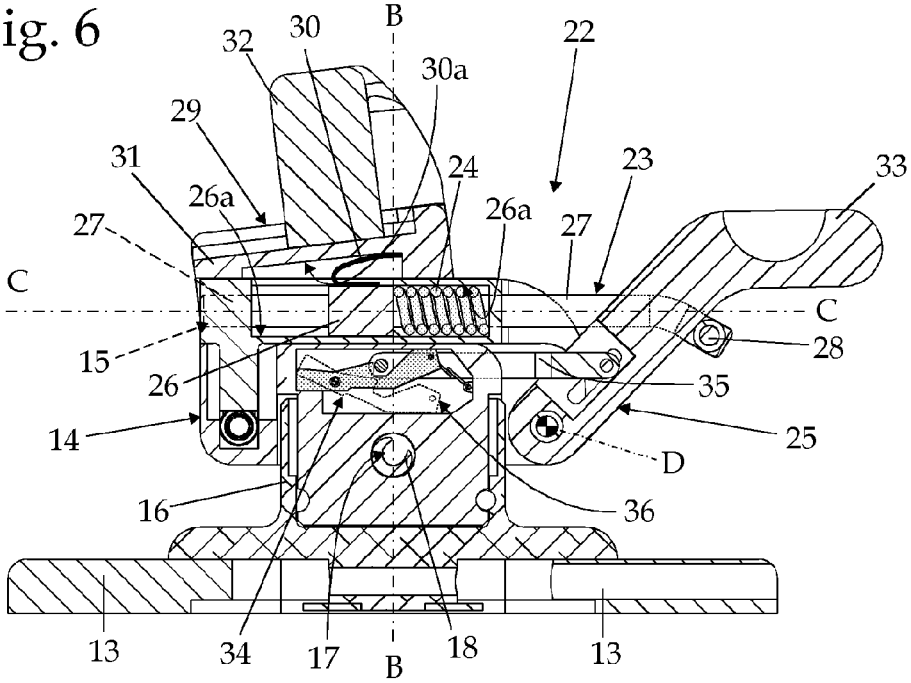
Figure 7:
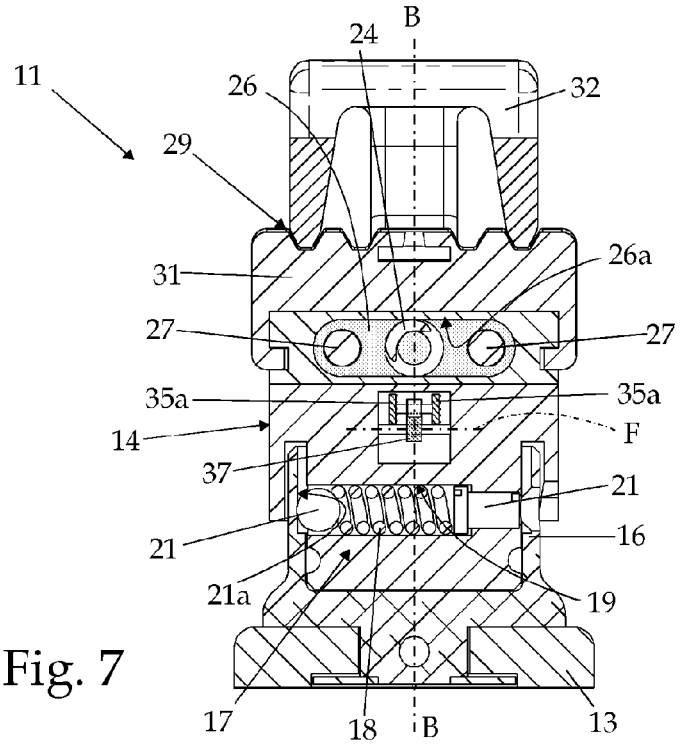
FIG. 7 is a front view of the heelpiece in FIG. 4 taken along section line H-H.

With reference to FIGS. 4, 5 and 6, in particular in the example shown, the heelpiece 11 comprises a latch element 23 which extends in a pass-through manner through the body of turret 14, thus remaining locally substantially coaxial, or however parallel, to the reference axis C of the projecting appendix 15, with the possibility of moving forwards and backwards with respect to the turret 14 parallel to axis C.

The hooking projecting appendix 15 consists of the tip of the latch element 23, and the command device 22 is structured so as to move the latch element 23 forward and backward on the turret 14 parallel to axis C, and then to stably lock the latch element 23 alternatively in two different working positions.

More in detail, the command device 22 is structured so as to move and lock the latch element 23 to an advanced position (see FIGS. 4 and 5), in which the tip 15 of the latch element 23 juts out from the body of the turret 14 by a predetermined length $l_1$ sufficient to completely engage the rear part of the shell 4 so as to prevent any rotation of the ski boot 2 about axis A; or to a retracted position (see FIG. 6) in which the tip of the latch element 23 is either completely retracted within the body of turret 14, or juts out from the body of turret 14 by a length $l_2$ which is considerably shorter than the length $l_1$, so as not to reach and lock the rear part of shell 4.

Obviously, the hooking projecting appendix 15 is in the completely extracted position when the latch element 23 is in the advanced position.

With reference to FIG. 4, in the example shown, the command device 22 preferably, but not necessarily, comprises: an antagonist elastic element 24, which is interposed between the latch element 23 and the body of turret 14, and is structured so as to bring and elastically maintain the latch element 23 in the advanced position (see FIGS. 4 and 5), which corresponds to arranging the hooking projecting appendix 15 in the completely extracted position; and a manually-operated moving member 25 which is interposed between the latch element 23 and the body of turret 14, and is structured so as to allow the user to move the latch element 23 from the advanced position to the retracted position, thus overcoming the elastic force of the antagonist elastic element 24.

Additionally, the manually-operated moving member 25 is also structured so as to selectively lock the latch element 23 in the retracted position, thus overcoming the elastic force of the antagonist elastic element 24.

With reference to FIGS. 4, 5 and 6, in particular in the example shown, the latch element 23 consists of a sliding shoe or carriage 26, which is inserted in an axially sliding manner into an elongated cavity 26*a* extending into the body of turret 14, thus remaining locally coaxial to the reference axis C of the projecting appendix 15; of a pair of rectilinear stems or pins 27 preferably, but not necessarily, with circular section, extending side by side and parallel to axis C, on opposite sides of the middle plane of turret 14, so as to completely cross the sliding shoe or carriage 26 and jut out from both sides of turret 14; and of a crosspiece 28 which is adapted to rigidly connect together the rear distal ends of the two pins 27, i.e. the ends which are on the opposite side with respect to tip 10.

The two rectilinear pins 27 are rigidly fixed to the sliding shoe or carriage 26 so as to move parallel to axis C, along with the sliding shoe or carriage 26; while, the front distal ends of the two rectilinear pins 27, i.e. the distal ends which face the tip 10 of the ski mountaineer binding device 1, are shaped/structured so as to be engaged in the rear part of shell 4 in order to stably retain the heel 6 of the ski boot 2 in abutment on, or however close to, the back of ski 3.

In other words, the front distal ends of the two rectilinear pins 27 can axially move from and to the tip 10 in order to couple and lock the rear part of the shell 4 hinged on the gripper-like clamping member 12 of the toepiece 10, thus forming the hooking projecting appendix 15 of the heelpiece 11.

With reference to FIGS. 4, 5 and 6, the elongated cavity 26*a* which is obtained within turret 14 is obviously shaped/dimensioned so as to allow the sliding shoe or carriage 26 to move within turret 14 parallel to axis C, between an advanced position (see FIGS. 3 and 4), in which the distal ends 15 of the two rectilinear pins 27 just out from the body of turret 14 by a predetermined length $l_1$ sufficient to completely engage the rear part of shell 4 so as to prevent any rotation of the ski boot 2 about axis A; and a retracted position (see FIG. 6), in which the distal ends 15 of the two rectilinear pins 27 are either completely retracted within the body of turret 14, or jut out from the body of turret 14 by a length $l_2$ which is much shorter than the length $l_1$, so as not to reach the rear part of shell 4.

Again with reference FIGS. 4, 5 and 6, the antagonist elastic element 24 instead preferably, but not necessarily, consists of a helical spring 24 or similar elastic member, extending into the elongated cavity 26*a*, locally substantially coaxial to axis C, so as to be arranged between the two rectilinear pins 27, and one of its two axial ends is stably in abutment on a body of the sliding shoe 26 and the other is on the body of turret 14. The helical spring 24 is additionally preloaded under compression so as to strongly push and maintain the sliding shoe or carriage 26 in abutment on the end of the elongated cavity 26*a* facing the toepiece 10, so as to make the distal ends 15 of the two rectilinear pins 27 protrude and maintain them either in the advanced or in the completely retracted position.

With reference to the appended claims, the heelpiece 11 is finally provided with a heel rising member 29 which is fixed on the top of the turret 14 with the possibility of moving on the turret 14 to and from a working position, in which the heel rising member juts beyond the side edge of the turret 14 to directly support the heel 6 of the ski boot 2 in a raised position; and with a mechanical member 30, which connects the heel rising member 29 to the latch element 23 underneath and is structured so as to transmit the translation motion of the latch element 23 to the heel rising member 29, so as to move the heel rising member 29 on the top of the turret 14 substantially along with the latch element 23.

More in detail, the heel rising member 29 is fixed onto the top of turret 14 with the possibility of sliding forwards and backwards on the 14 turret in a direction d locally substantially parallel to the reference axis C of the hooking projecting appendix 15, between a retracted or resting position (see FIG. 6), in which the heel rising member 29 is substantially aligned over the turret 14, and is further preferably confined within the perimeter of turret 14; and an advanced or working position (see FIG. 5), in which the heel rising member 29 juts out beyond the side edge of the turret 14, immediately over the hooking projecting appendix 15, so as to substantially cover as a roof the whole hooking projecting appendix 15 arranged in the completely extracted position, thus stably supporting/maintaining the heel 6 of the ski boot 2 in a raised/lifted position with respect to the back of ski 2.

In other words, when the heel rising member 29 is in the advanced or working position (see FIG. 5), it juts out beyond the side edge of the turret 14 by a length $l_3$ such as to exceed/pass beyond the distal ends 15 of the two rectilinear pins 27 which, in turn, jut out from the body of turret 14 by a length $l_1$ sufficient to completely engage the rear part of the shell 4 hinged onto the toepiece 10.

The mechanical member 30 is instead structured so as to move the heel rising member 29 to the retracted or resting position when the latch element 23 moves to the retracted position to arrange the distal ends 15 of the two rectilinear pins 27, i.e. the hooking projecting appendix 15, in the retracted position; and to move the heel rising member 29 to the advanced or working position when the latch element 23 moves to the advanced position in order to arrange the distal ends 15 of the two rectilinear pins 27 in the completely retracted position.

More in detail, in the example shown, the mechanical member 30 is preferably structured so as to rigidly restrain the heel rising member 29 to the latch element 23, when the latch element 23 moves from the advanced position to the retracted position; and to elastically restrain the heel rising member 29 to the latch element 23, when the latch element 23 moves from the retracted position to the advanced position.

With particular reference to FIGS. 2, 3 and 4, in particular in the example shown, the heel rising member 29 comprises a main supporting plate 31, which rests on the top of turret 14, and is slidingly fixed to the body of turret 14 so as to slide forwards and backwards on the top of turret 14 in a direction $d_a$ locally substantially parallel to the reference axis C of the hooking projecting appendix 15; and preferably also an auxiliary supporting block 32, which rests on the upper face of the main supporting plate 31, and is slidingly fixed onto the body of the supporting plate 31, so as to slide forwards and backwards on the top of the supporting plate 31 in a direction $d_b$ preferably locally substantially parallel to the reference axis C of the hooking projecting appendix 15.

Both the supporting plate 31 and the auxiliary supporting block 32 are structured to support the heel 6 of ski boot 2.

The mechanical member 30, instead, is structured so as to connect the main supporting plate 31 of the heel rising member 29 to the latch element 23 immediately underneath, so as to move the main supporting plate 31 between a retracted or resting position (see FIG. 6), in which the supporting plate 31 is substantially confined within the perimeter of the top of turret 14, and an advanced or working position (see FIG. 5), in which the main supporting plate 31 juts out beyond the side edge of turret 14, immediately over the hooking projecting appendix 15, so as to substantially cover as a roof the whole hooking projecting appendix 15 arranged in the completely extracted position.

In particular, in the example shown, the mechanical member 30 comprises a flexible tongue 30 made of an elastically deformable material, which is substantially C-folded, and is rigidly fixed to the sliding shoe or carriage 26 of the latch element 23, so as to jut out from the top of the turret 14 through a longitudinal through slot which extends parallel to the reference axis C of the latch element 23. The upper edge of the flexible tongue 30 is adapted to rest and slide on the body of the main supporting plate 31 of the heel rising member 29, on a bottom of a longitudinal groove 30*a* which extends on the lower face of the supporting plate 31 parallel to reference axis C.

The bottom of the longitudinal groove 30*a* is further inclined by a few degrees towards the tip 15 of the latch element 23, i.e. towards the distal ends 15 of the rectilinear pins 27, so as to transform the upward elastic force exerted by the flexible tongue 30, into a horizontal elastic force f which tends to push the supporting plate 31 to the advanced or working position (see FIGS. 4 and 5) with an increasing intensity as a function of the misalignment between the position of the supporting plate 31 and that of the sliding shoe or carriage 26 of the latch element 23.

With reference to the accompanying figures, the manually-operated moving member 25 which allows the user to move the latch element 23 forwards and backwards thus overcoming the force of the helical spring 24, comprises instead:

- a command lever 33 which is hooked to the rear part of the latch element 23, and has its lower end hinged on the side edge of turret 14, on the opposite side with respect to the hooking projecting appendix 15, so as to freely oscillate about a rotation axis D locally substantially perpendicular to axes B and C, while remaining on a lying plane locally and substantially coplanar to the first reference axis (C); and a locking device 34 which is interposed between the turret 14 and the command lever 33, and is capable of immobilizing/locking in a rigid and stable, although easily releasable manner the command lever 33 in an intermediate unlocking position (see FIGS. 3 and 6), in which the command lever 33 is tilted with respect to the vertical by a predetermined angle, so as to arrange and maintain the latch element 23 in the retracted position, thus overcoming the force of the helical spring 24.

More in detail, the locking device 34 is structured so as to allow the command lever 33 to oscillate about axis D to be alternatively arranged in a locking position (see FIGS. 2 and 4), in which the command lever 33 is arranged in a substantially vertical position, so as to allow the antagonist elastic element 24 to arrange the latch element 23 in the advanced position; in an unlocking position (see FIGS. 3 and 6), in which the command lever 33 is tilted by predetermined angle with respect to the vertical, so as to arrange and maintain the latch element 23 in the retracted position, thus overcoming the force of the helical spring 24; and finally in a switching position, in which the command lever 33 is tilted by a predetermined angle larger than that taken in the unlocking position.

The locking device 34 is further structured so as to allow the command lever 33 to move/pass from the unlocking position to the locking position, exclusively after the command lever 33 has been temporarily positioned in the switching position.

In particular, in the example shown, the command lever 33 engages in a pass-through manner the recess delimited by the two rectilinear pins 27 and by the stiffening crosspiece 28 of the latch element 23, so as to rest and freely slide on the stiffening crosspiece 28 of the latch element 23.

With reference to FIG. 4, the locking device 34 comprises instead a rigid longitudinal stem or strut 35, which has a first end hinged in a freely rotational and sliding manner within a transversal guide slot 33*a* made on the body of the command lever 33, and a second end inserted in an axially sliding manner into the body of turret 14, immediately underneath the latch element 23; and a flip-flop snap locking mechanism 36 which is accommodated within turret 14, immediately under the latch element 23, and is structured so as to selectively prevent the second end of the first rigid strut 35 from penetrating into the body of turret 14 beyond a predetermined limit which corresponds to arranging the command lever 33 in the above-mentioned unlocking position.

More in detail, the snap locking mechanism 36 is structured so as to allow the longitudinal strut 35 to slide into turret 14 between an advanced position, which corresponds to the command lever 33 arranged in the locking position, and a retracted position which corresponds to the command lever 33 arranged in the switching position; and it is furthermore structured so as to selectively stop/lock the stroke of strut 35 towards the advanced position, when the strut 35 is in an intermediate position between the advanced position and the retracted position.

The command lever 33 is in the unlocking position when the strut 35 is in the intermediate position, and the snap locking mechanism 36 is finally structured so as to be arranged in/switch to the configuration which leaves strut 35 free to complete the stroke towards the advanced position, when the longitudinal strut 35 is temporarily taken to the retracted position.

In particular, in the example shown, the portion of strut 35, which is slidingly inserted into turret 14, extends along a reference axis E which is locally substantially coplanar and preferably also substantially parallel to axis C of the latch element 23.

Furthermore, the longitudinal strut 35 preferably, but not necessarily, consists of a fork element 35 which has its central trunk hinged directly onto the command lever 33 by means of a transversal pin which may freely slide within the guide slot 33*a* made on the body of the command lever 33, and has the two arms or tines 35*a* which extend in an axially sliding manner into turret 14, where the snap locking mechanism 36 is accommodated.

Figure 8:
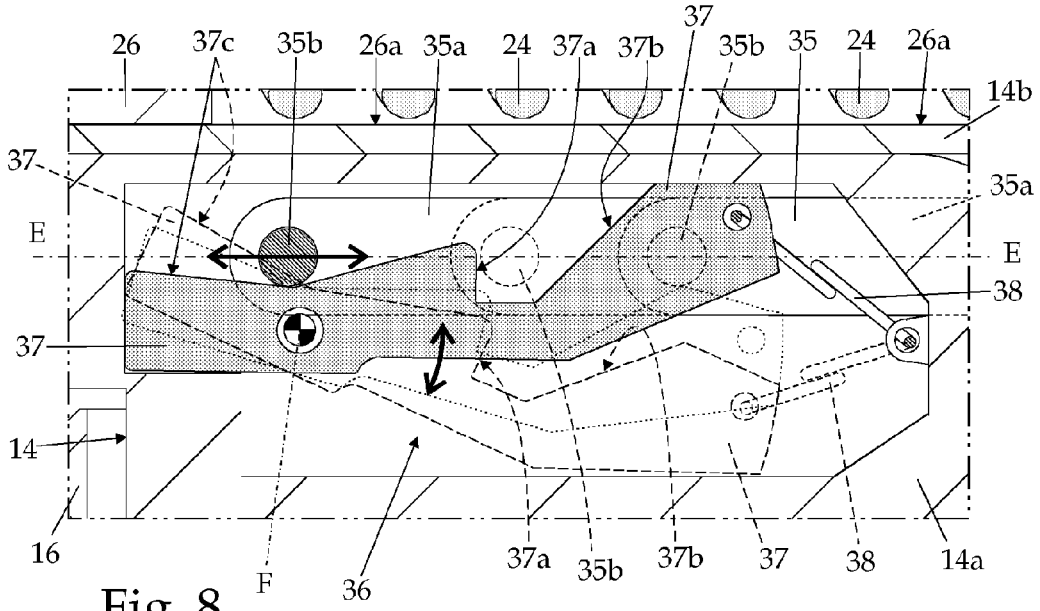
FIG. 8 shows a detail of the heelpiece in FIG. 4 on an enlarged scale.

With reference to FIGS. 4 and 8, the snap locking mechanism 36 preferably comprises instead a pivoting rocker arm 37 which is fixed within turret 14, next to the second end of the rigid strut 35, with the possibility of freely oscillating while remaining on a laying plane locally and substantially coplanar to the longitudinal axis E of the rigid strut 35; and an elastic member 38, here a scissor-like spring, which is interposed between the pivoting rocker arm 37 and the turret 14, and is structured so as to elastically maintain the rigid strut 35, either selectively or alternatively in two different operating positions.

In the first operating position, the pivoting rocker arm 37 is close to the rigid strut 35, and can hook the rigid strut 35 thus preventing it from completing the movement from the intermediate position to the advanced position, i.e. from further penetrating into the body of turret 14. In the second operating position, the pivoting rocker arm 37 is instead away from the rigid strut 35, and allows the rigid strut 35 to freely move with respect to turret 14, parallel to axis E and towards the advanced position.

In particular, in the example shown, the pivoting rocker arm 37 is preferably hinged onto the turret 14 so as to freely oscillate about a transversal rotation axis F which is locally substantially orthogonal to reference axis E of the rigid strut 35, while remaining on a laying plane locally substantially coplanar or however parallel to axes B and E, and preferably also substantially coinciding with the middle plane P of turret 14.

The pivoting rocker arm 37 is structured/shaped so as to automatically cause the movement of the rocker arm from the second to the first operating position, when the longitudinal strut 35 reaches the advanced position under the force of the elastic element 24; and so as to automatically cause the movement of the rocker arm from the first to the second operating position, when the longitudinal strut 35 reaches the retracted position being pulled by the command lever 33.

More in detail and with particular reference to FIG. 8, the pivoting rocker arm 37 is preferably placed between the two arms or tines 35*a* of the strut 35, and is provided with a detent 37*a* which projects towards the strut 35 immediately above, at a predetermined distance from the rotation axis F, and is dimensioned so as to hook a transversal pin 35*b* which rigidly connects together the arms or tines 35*a* of the strut 35, when the pivoting rocker arm 37 is in the first operating position. At a greater distance from the rotation axis F with respect to detent 37*a*, the pivoting rocker arm 37 further has a first switching crest 37*b* with a cam profile which extends towards the strut 35 so as to intersect the trajectory of the transversal pin 35*b* of strut 35 when the rigid strut 35 moves from the intermediate position to the retracted position.

The switching crest 37*b* is shaped so as to oblige the pivoting rocker arm 37 to rotate about axis F against the force of the elastic element 38, to pass beyond the unstable balance point which forces/obliges the elastic element 38 to move the pivoting rocker arm 37 to the second operating position.

On the opposite side with respect to the detent 37*a* and the switching crest 37*b*, the pivoting rocker arm 37 finally has a second switching crest 37*c* with a cam profile which extends towards the strut 35 so as to intersect the trajectory of the transversal pin 35*b* of strut 35 when the rigid strut 35 reaches the advanced position.

The switching crest 37*c* is shaped so as to oblige the pivoting rocker arm 37 to rotate about axis F against the force of the elastic element 38, to pass beyond the unstable balance point which forces/obliges the elastic element 38 to move the pivoting rocker arm 37 back to the first operating position.

Figure 9:
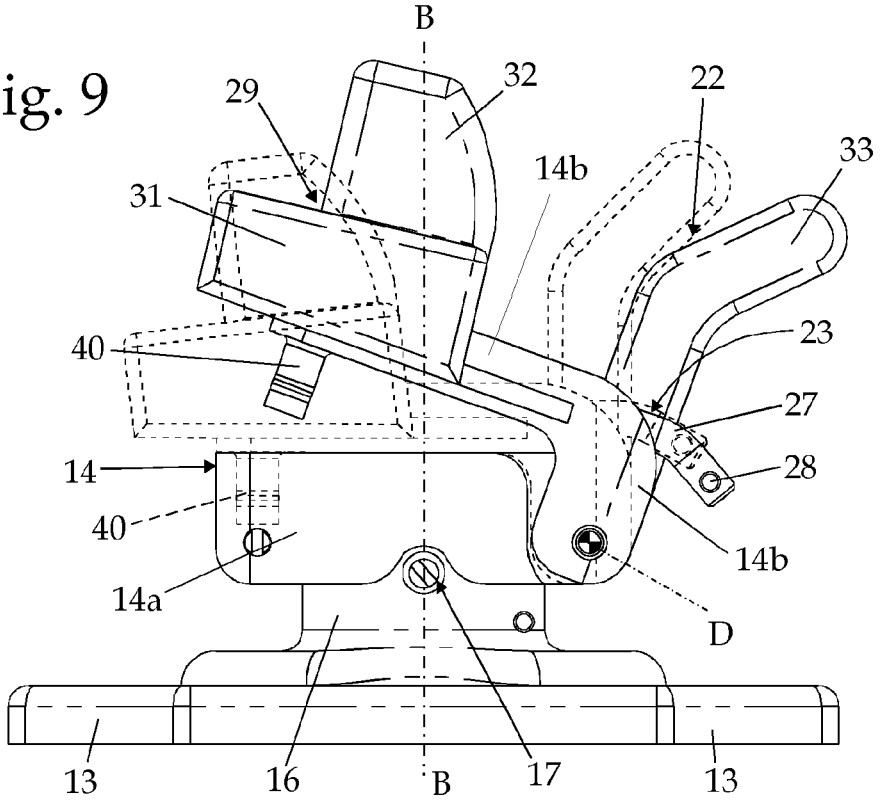
Figure 10:
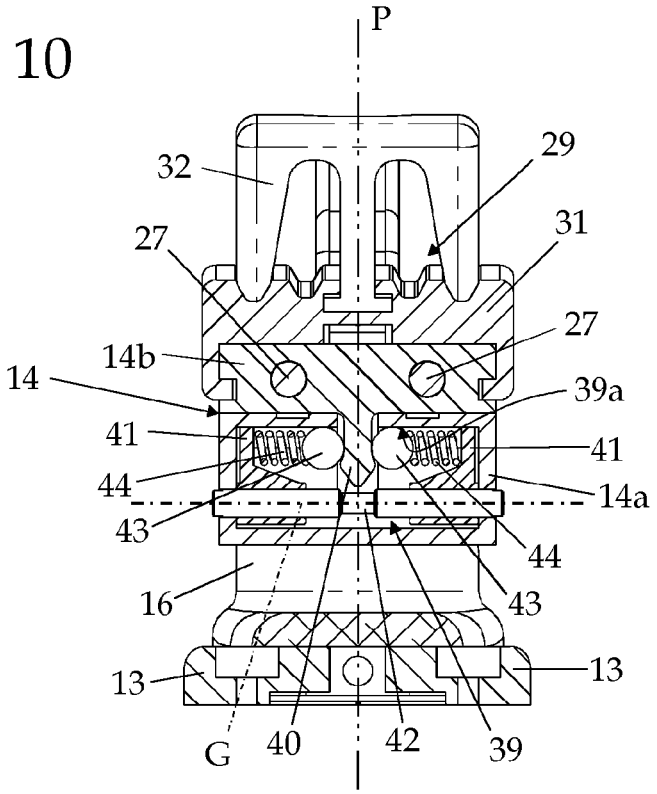
FIG. 10 is a front view of the heelpiece shown in FIG. 4, taken along section line K-K and with parts removed for clarity.

Finally, with particular reference to FIGS. 4, 9 and 10, in the example shown, the turret 14 is preferably, but not necessarily, divided into a lower fixed casing 14*a* which is either rigidly fastened or connected in an axially rotational manner directly to the fastening plate 13, and a tiltable upper casing 14*b*, which rests on the top of the lower casing 14*a*, and is hinged onto the lower casing 14*a* on the opposite side with respect to the hooking projecting appendix 15, so as to freely rotate about a transversal reference axis, which is locally substantially orthogonal to axes B and C and preferably, but not necessarily, coinciding with the rotation axis D of the command lever 33 on turret 14.

In particular, in the example shown, the lower part of the lower casing 14*a* is locked in an axially rotational manner within the tubular hub 16, so as to allow the whole turret 14 to rotate about axis B, and the elastic locking member 17 is structured so as to allow the rotation of the lower casing 14*a* about axis B when the twisting torque exceeds a predetermined threshold value.

The lower casing 14*a* of the turret carries the command lever 33 hinged on a side edge thereof, is engaged in a slidingly axial manner by the second end of the longitudinal strut 35, and internally accommodates the snap locking mechanism 36; i.e. directly supports the whole manually-operated moving member 25. The upper casing 14*a* of the turret is instead engaged in an axially sliding manner by the latch element 23, and internally accommodates the helical spring 34 preloaded under compression which elastically pushes and maintains the latch element 23 in the advanced position, i.e. with the front distal ends 15 of the two rectilinear pins 27 which jut out from the body of turret 14 by a length $l_1$ sufficient to completely engage the rear part of shell 4 so as to prevent the ski boot 2 from rotating about axis A.

Additionally, turret 14 is finally provided with a programmed-release locking means 39 which is preferably, but not necessarily, accommodated within the lower casing 14*a* of the turret and structured so as to lock and maintain the tiltable upper casing 14*b* in abutment on the lower casing 14*a* with the reference axis C of the latch element 23 arranged substantially parallel to the longitudinal ski axis L, until the tilting torque transmitted by the tiltable upper casing 14*b* exceeds a predetermined threshold value; and to completely release the tiltable upper casing 14*b* from the lower casing 14*a* when the tilting torque transmitted to the tiltable upper casing 14*b* exceeds the aforesaid threshold value, so as to allow the tiltable upper casing 14*b* to freely rotate backwards about the articulation axis of the hinge, i.e. about axis D.

When the tiltable upper casing 14*b* tilts backwards while rotating about axis D, the crosspiece 28 of the latch element 23 moves away from the command lever 33, whereby the manually-operated moving member 25 does not obstruct/prevent the free tilting movement of the tiltable upper casing 14*b*.

In particular, in the example shown, the top of the lower casing 14*a* preferably, but not necessarily, has a substantially parallelepiped shape and ends at the top with a flat surface which is locally substantially perpendicular to axis B.

The tiltable upper casing 14*a* is instead substantially shaped like an inverted L and rests on the lower casing 14*a* so that the upper horizontal segment rests directly on the upper flat surface of the lower casing 14*a*, and its lower vertical segment rests on the side edge of the lower casing 14*a*, from the side opposite to the hooking projecting appendix 15.

The latch element 23 is inserted in an axially sliding manner into the upper horizontal segment of the tiltable upper casing 14*b*, while the lower end of the vertical segment of the tiltable casing 14*b* is directly hinged onto the side edge of the lower casing 14*a*, by means of a through pin which extends coaxially to axis D also engaging the end of the command levers 33.

With reference to FIGS. 9 and 10, the programmed-release locking member 39 is instead preferably placed within a second cavity 39*a* appropriately made in the lower casing 14*a*, next to the side edge from where the hooking projecting appendix 15 juts out in a retractable manner, and is structured so as to clamp and retain, until the extraction force exceeds a predetermined threshold value, a hooking tooth 40 which protrudes from the tiltable upper casing 14*b*, and penetrates into the lower casing 14*a* through a specific slot to reach the locking member 39.

More in detail, in the example shown, the hooking tooth 40 protrudes from the lower face of the tiltable casing 14*b*, while remaining preferably substantially coplanar to the middle plane P of the turret 14, while the locking member 39 preferably comprises:

- two thrust bearing jaws 41, which are arranged within the cavity 39*a* which accommodates the locking member 39, on opposite sides of the middle plane P of the turret where there is the hooking tooth 40;
- a manually-operated jaw adjusting mechanism 42, which is able to displace the two thrust bearing jaws 41 from and towards the middle plane of the turret, so as to adjust the distance existing between each thrust bearing jaw 41 and the middle plane P of turret 14;
- two locking balls 43, which are arranged in abutment against the side edges of the hooking tooth 40, on opposite sides thereof, so as to be aligned each to a respective thrust bearing jaw 41; and finally
- two helical springs 44 or similar elastic elements, each of which is interposed between a corresponding thrust bearing jaw 41 and the corresponding locking ball 43, so as to strongly push the locking ball 43 into abutment against the edge of the hooking tooth 40.

The preload of the helical springs 44 is adjusted by varying, by means of the adjustment mechanism 42, the distance which separates the two thrust bearing jaw 41 from the middle plane of turret 14, where the hooking tooth 40 lays.

The hooking tooth 40 and the locking balls 43 are shaped/dimensioned so as to generate an elastic recalling force parallel to the tooth, which tends to pull the hooking tooth 40 into the lower casing 14*a*; and so as to prevent the hooking tooth 40 from being extracted out of the lower casing 14*a* until the extraction force is maintained under the predetermined limit value, which depends on the force with which the helical springs 43 squeeze the locking balls 43 against the hooking tooth 40.

With reference to FIG. 10, in particular in the example shown, the jaw adjusting mechanism 42 consists of a transversal supporting shaft 42, which extends coaxially to a reference axis G locally substantially perpendicular to the middle plane P of turret 14 (i.e. locally substantially parallel to the rotation axis D of the tiltable upper casing 14*b*) and engages the tiltable lower casing 14*a* of the head 14 in a pass-through and axially rotational manner, intersecting the cavity 39*a* which accommodates the locking member 39.

The supporting shaft 42 has, on opposite sides of the middle plane P of turret 14, two threaded portions with a specular thread, and the two thrust bearing jaws 41 are screwed each on a respective threaded portion, so that the rotation of the supporting shaft 42 about axis G allows to simultaneously approach/space apart the two thrust bearing jaws 41 from the middle plane P of turret 14.

The operation of the ski mountaineering binding device 1 can be easily inferred from the above description and no further explanations are thus required, except to explain that by moving the latch element 23 forwards and backwards, i.e. the hooking projecting appendix 15 of heelpiece 11, the rear part of shell 4 can be rapidly hooked to/unlocked from the heelpiece 11 without needing to unlock the front part of shell 4 from the toepiece 10.

The movement of the latch element 23 further controls the movement of the heel rising member 29 on the top of turret 14, thus considerably simplifying the ski mountaineering binding device 1. Indeed, by virtue of the elastic connection between the heel rising member 29 and the latch element 23, the heel rising member 29 is arranged in the advanced or working position (see FIG. 5) only if the rear part of shell 4 is over the heelpiece 11, and does not obstruct/prevent in any way the contextual movement of the latch element 23 to the advanced position (see FIGS. 3 and 4).

There are many advantages deriving from the particular structure of the heelpiece 11. It is indeed apparent that the possibility of releasing the rear part of shell 4 from the heelpiece 11 and/or the possibility of moving the heel rising member 29 to the working position without needing to unlock the front part of shell 4 from the gripper-like clamping member of the toepiece, greatly increases the functionality of the ski mountaineering binding device 1 to the advantage of the skier's safety.

It is finally apparent that changes and variants can be made to the above-described ski mountaineering binding device 1, without departing from the scope of protection of the present invention.

For example, the latch element 23 may be provided with a single projecting pin with juts out from the body of turret 14, being coaxial to axis C, and has a distal end shaped so as to engage the rear part of shell 4 roughly at the heel.

Therefore, in this variant, the hooking projecting appendix 18 of the heelpiece 11 consists of this joined projecting pin.

Moreover, the flexible tongue 30 could be replaced by a helical spring or the like and accommodated within the longitudinal groove 30*a* substantially parallel to axis C; has one end abutting on the supporting plate 31 at the front end of the longitudinal groove 30*a*; and finally has its second end abutting a rigid fin which juts out towards the sliding shoe or carriage 26, and protrudes into the longitudinal groove 30*a* thus engaging the usual longitudinal through slot which extends parallel to the reference axis C of the latch element 23.

In this variant, the helical spring tends to be compressed when the latch element 23 goes to the advanced position, thus elastically pushing the supporting plate 31 to the working position; while the rigid fin of the sliding shoe or carriage 26 abuts on the supporting plate 31 at the rear end of the longitudinal groove 30*a*, then the latch element 23 moves to go back to the retracted position, dragging the supporting plate 31 to the resting position.

The invention claimed is:

1. A ski binding device for fastening a mountaineering boot on a downhill ski or the like, of the type comprising;

a toepiece and a heelpiece which are adapted to be rigidly fixed on the back of a ski, aligned along a ski longitudinal axis (L), and are structured so as to selectively retain respectively a front part and a rear part of a shell of a boot;

the toepiece being provided with a clamping member which is structured for selectively clamping and stably retaining the front part of the shell, and at the same time allowing the shell to pivot freely on the toepiece about a boot rotation axis (A) which is substantially perpendicular to the ski longitudinal axis (L);

the heelpiece comprising a fastening base structured for being rigidly fastened on the back of the ski; a turret protruding upwards from the fastening base; and a hooking projecting appendix that juts out from the turret towards the toepiece while remaining substantially parallel to a first reference axis (C) substantially aligned to the ski longitudinal axis (L), and is structured so as to couple to the rear part of the shell to stably retain the heel of the boot in abutment on or close to the back of the ski, therefore preventing any rotation of the boot on the toepiece about said boot rotation axis (A);

the binding device being characterized in that the heelpiece comprises a latch element which extends in pass-through manner through the body of the turret while remaining substantially parallel to said first reference axis (C), with the possibility of moving forwards and backwards with respect to the turret parallelly to said first axis (C), the hooking projecting appendix being formed by the tip of said latch element;

a heel rising member which is fixed on the top of the turret with the possibility of moving on the turret from and towards a working position in which the heel rising member juts out beyond the side edge of the turret to directly support the heel of the boot in a raised position; and a mechanical connecting member which is adapted to connect the heel rising member to the underlying latch element, and is structured so as to transmit the translating motion of the latch element to the heel rising member, so as to move the heel rising member on the top of the turret (14) substantially together with the latch element (23).

2. The ski binding device according to claim 1, wherein the heel rising member is fixed on the top of the turret with the possibility of sliding forwards and backwards in a direction substantially parallel to said first reference axis (C), between said working position in which the heel rising member juts out beyond the side edge of the turret, immediately above the hooking projecting appendix; and a resting position in which the heel rising member is substantially aligned above the turret.

3. The ski binding device according to claim 1, wherein the latch element is movable between an advanced position in which the tip of the latch element protrudes from the body of the turret by a first predetermined length ($l_1$) sufficient to engage the rear part of the shell so as to avoid any rotation of the boot about the boot rotation axis (A); and a retracted position in which the tip of the latch element is retracted within the body of the turret or protrudes from the body of the turret by a second length ($l_2$) having a value such as to prevent the hooking projecting appendix to reach and lock the rear part of the shell.

4. The ski binding device according to claim 3, wherein the mechanical connecting member is structured so as to move the heel rising member in the working position when the latch element moves in the advanced position, and so as to move the heel rising member in the resting position when the latch element moves in the retracted position.

5. The ski binding device according to claim 4, wherein the mechanical connecting member is structured so as to rigidly constrain the heel rising member to the latch element when the latch element moves from the advanced position to the retracted position, and so as to elastically constrain the heel rising member to the latch element when the latch element moves from the retracted position to the advanced position.

6. The ski binding device according to claim 5, wherein the mechanical connecting member comprises a flexible tongue made of elastically deformable material, which is substantially C-folded and is rigidly fixed on the latch element so as to protrude from the top of the turret through a longitudinal through-slit which extends parallelly to said first reference axis (C); the top side of the flexible tongue being adapted to rest and slide on the body of the heel rising member, on the bottom of a longitudinal groove which is inclined towards the tip of the latch element.

7. The ski binding device according to claim 3, wherein the heelpiece also comprises a manually-operated command device which is structured for displacing the latch element forwards and backwards on the turret, and then stably locking said latch element in the advanced position or in the retracted position.

8. The ski binding device according to claim 7, wherein the command device comprises an antagonist elastic element which is interposed between the latch element and the body of the turret, and is structured so as to bring and elastically maintain the latch element in the advanced position; and a manually-operated moving member which is interposed between the latch element and the body of the turret, and is structured so as to allow the user to move the latch element from the advanced position to the retracted position, overcoming the elastic force of the antagonist elastic element.

9. The ski binding device according to claim 8, wherein the manually-operated moving member is also structured so as to selectively lock the latch element in the retracted position, overcoming the elastic force of the antagonist elastic element.

10. The ski binding device according to claim 9, wherein the manually-operated moving member comprises:

a command lever which is hooked to the rear part of the latch element, and has the lower end hinged on the side edge of the turret, on the opposite side with respect to said hooking projecting appendix, so as to freely oscillate while remaining on a lying plane coplanar to said first reference axis (C); and a locking device which is interposed between the turret and the command lever, and is able to lock in a rigid and stable, although easily releasable manner said command lever in an intermediate unlocking position, in which the command lever is tilted with respect to the vertical by a predetermined angle, so as to arrange and maintain the latch element in the retracted position.

11. The ski binding device according to claim 10, wherein the locking device is structured so as to allow the command lever to oscillate about a rotation axis (D) substantially perpendicular to said first reference axis (C) for being alternatively arranged in a locking position in which the command lever is arranged substantially vertically, so as to allow the antagonist elastic element to arrange the latch element in the advanced position;

in an unlocking position in which the command lever is tilted with respect to the vertical by a predetermined angle, so as to arrange and maintain the latch element in the retracted position overcoming the force of the antagonist elastic element; and finally in a switching position in which the command lever is tilted with respect to the vertical by a predetermined angle broader than that taken in the unlocking position;

the locking device being also structured so as to allow the command lever to move/pass from the unlocking position to the locking position, exclusively after the command lever has been temporarily positioned in said switching position.

12. The ski binding device according to claim 1, wherein the heel rising member comprises a main supporting plate which rests on the top of the turret, and is fixed in sliding manner on the body of the turret so as to slide forwards and backwards on the turret in a direction substantially parallel to said first reference axis (C); and an auxiliary supporting block which rests on the top face of the main supporting plate, and is slidingly fixed on the body of the main supporting plate so as to slide forwards and backwards on the supporting plate in a direction substantially parallel to said first reference axis (C).

13. The ski binding device according to claim 1, wherein the turret is fixed to the fastening base with the possibility of freely rotating about a second reference axis (B) substantially perpendicular to the ski longitudinal axis (L), and in that the heelpiece is also provided with an elastic locking member which is structured so as to allow rotation of the turret about said second reference axis (B) when the torque exceeds a predetermined threshold value.

* * * * *